US009834005B2

(12) United States Patent
Curran

(10) Patent No.: US 9,834,005 B2
(45) Date of Patent: Dec. 5, 2017

(54) METHOD FOR CIRCULATION OF A LIQUID IN A PRINTER

(71) Applicant: Océ Holding B.V., Venlo (NL)

(72) Inventor: Josh Curran, Vancouver (CA)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/454,977

(22) Filed: Mar. 9, 2017

(65) Prior Publication Data

US 2017/0266978 A1 Sep. 21, 2017

(30) Foreign Application Priority Data

Mar. 16, 2016 (EP) ..... 16160717

(51) Int. Cl.

| | |
|---|---|
| ***B41J 2/175*** | (2006.01) |
| ***B41J 2/18*** | (2006.01) |
| ***B41J 2/165*** | (2006.01) |
| ***B41J 2/17*** | (2006.01) |
| ***B41J 2/21*** | (2006.01) |
| ***B41J 2/155*** | (2006.01) |

(52) U.S. Cl.

CPC ..... *B41J 2/17596* (2013.01); *B41J 2/155* (2013.01); *B41J 2/16517* (2013.01); *B41J 2/16585* (2013.01); *B41J 2/175* (2013.01); *B41J 2/1707* (2013.01); *B41J 2/18* (2013.01); *B41J 2/2146* (2013.01); *B41J 2002/16594* (2013.01)

(58) Field of Classification Search

CPC .... B41J 2/17596; B41J 2/2146; B41J 2/1707; B41J 2/16585; B41J 2/175; B41J 2/16517; B41J 2/155; B41J 2/18; B41J 2002/16594

See application file for complete search history.

(56) References Cited

U.S. PATENT DOCUMENTS

| | | | | |
|---|---|---|---|---|
| 8,544,991 | B2 | 10/2013 | Gray et al. | |
| 2014/0320571 | A1 | 10/2014 | Enomoto et al. | |
| 2015/0360190 | A1* | 12/2015 | Sakai | B41J 29/00 366/153.1 |

FOREIGN PATENT DOCUMENTS

| | | | |
|---|---|---|---|
| EP | 2 082 883 | A2 | 7/2009 |
| WO | WO 2013/150396 | A1 | 10/2013 |

* cited by examiner

*Primary Examiner* — Julian Huffman

(74) *Attorney, Agent, or Firm* — Birch, Stewart, Kolasch & Birch, LLP

(57) ABSTRACT

The present invention relates to a method for circulating a liquid in a printer to prevent settling of dispersed particles in the liquid anywhere in said printer by controlling the recirculation of liquid for each printhead in said printer.

6 Claims, 1 Drawing Sheet

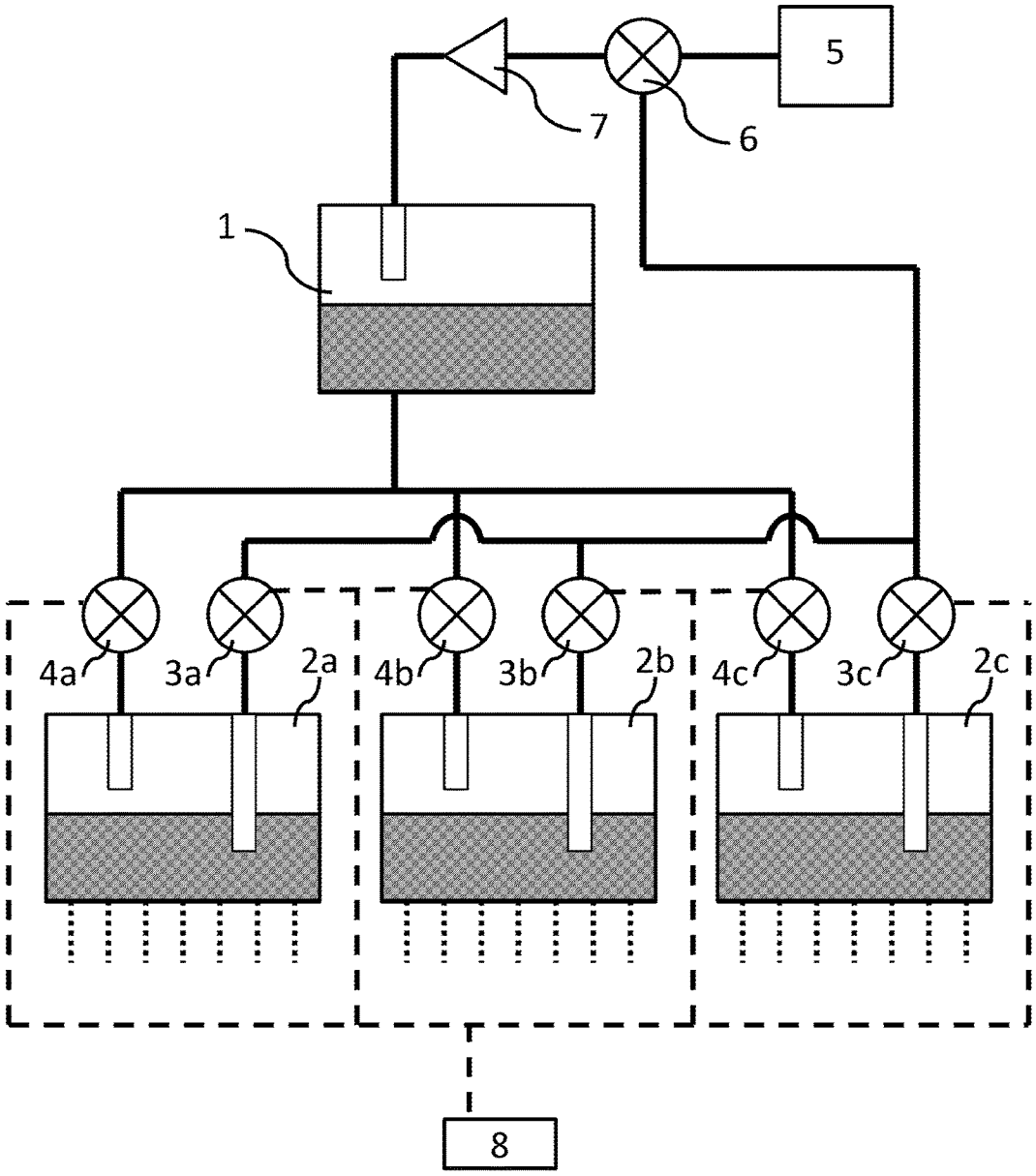
5
7
6
1
4a
3a
2a
4b
3b
2b
4c
3c
2c
8

METHOD FOR CIRCULATION OF A LIQUID IN A PRINTER

FIELD OF THE INVENTION

The present invention relates to a method for circulating a liquid in a printer to prevent settling of dispersed particles in the liquid anywhere in said printer.

BACKGROUND ART

In a copier, a printer or any other machine in which an image is created using a liquid such as an ink, dispersed particles in the liquid may settle when the liquid is not regularly agitated. For instance, pigment particles of an ink suspension may settle over time if the ink is not in motion. This will result in a reduced image quality and might even result in clogging of nozzles in a printhead used to create said images.

To agitate the liquid in a printer, for example to maintain the suspension of an ink, the liquid flow path in a printer is circulated regularly. This can be seen for instance in patent application WO 2013/150396 and patent U.S. Pat. No. 8,544,991.

The printing unit in the known art is a page wide printing unit to encompass the width of the medium to be printed on. All the printheads in the printing unit for a single color are connected to a single liquid handling system. Thus the liquid can only be circulated through all the printheads at the same time.

Therefore, the printing unit disclosed in the prior art is only suitable for circulation of liquid to agitate the liquid in a maintenance mode to prevent any printing deficiencies. This creates a loss in productivity.

It is therefore a disadvantage of the printing unit known from the prior art that the circulation of the liquid can only be performed while the printer is not in a printing mode, leading to a loss in productivity.

Furthermore, even if the liquid circulation in a printing unit according to the prior art would be performed in a printing mode (i.e. during printing an image), unequal liquid consumption by the individual printheads of the printer configuration of the known art may cause different pressures in each printhead. This creates a preferred flow of the liquid through the printhead having the highest liquid consumption due to pressure in this printhead being lower than the printheads where the liquid consumption is lower. The risk of settling of dispersed particles is the smallest in the printhead having the highest liquid consumption when compared to the other printheads.

Therefore the agitation of the liquid will differ in each printhead when operated in a printing mode and an equal suspension of dispersed particles in the liquid flowing through each individual printheads cannot be maintained or at least not guaranteed in said printing mode.

Thus, a maintenance mode is required to agitate the liquid in each individual printhead. The maintenance frequency, meaning the amount of times circulation of liquid to agitate the liquid is performed, will thus be determined by the printhead where the agitation is the most necessary due to the flow though this printhead being the smallest.

It is therefore an object of the present invention to overcome or at least mitigate above stated disadvantages by providing sufficient agitation in each of the printheads of a printhead array such that settling of dispersed particles is prevented and the maintenance frequency reduced.

SUMMARY OF THE INVENTION

The object of the invention is achieved in a method for recirculation of a liquid in a printer, wherein the printer comprises an intermediate liquid reservoir, a controller for controlling the recirculation of the liquid, and a first liquid handling system and at least one second liquid handling system, wherein each liquid handling system comprises: a printhead, being in liquid connection with the intermediate liquid reservoir; and a means for recirculating a liquid to the intermediate liquid reservoir, a valve to regulate the recirculation, wherein the method comprises the steps of opening the valve to regulate the recirculation in the first liquid handling system; closing the valve to regulate the recirculation in the at least one second liquid handling system; activate the means for recirculating a liquid to start recirculation of the liquid from the printhead in the first liquid handling system back to the intermediate liquid reservoir, while simultaneously drawing liquid from the intermediate liquid reservoir into the printhead in the first liquid handling system, thereby setting the recirculation of at least two liquid handling systems differently to regulate the agitation of liquid in the at least two corresponding printheads. In an embodiment, the circulation is regulated during a printing mode of the printer in which the printer is operating to form an image. It is an additional advantage of the present embodiment that the loss of printing productivity is reduced.

In an embodiment, the circulation of each liquid handling system is dynamically adjusted according to the consumption of liquid of each corresponding printhead. It is an additional advantage of the present embodiment that the liquid is agitated first in the printhead where agitation of the liquid is required the most.

In an embodiment, the controller adjusts the settings of any of the valves dependent on the image being printed. It is an additional advantage of the present embodiment that the liquid is agitated first in the printhead which is used the least for printing an image.

In an embodiment, the circulation is regulated during a maintenance mode of the printer in which the printer is performing maintenance action and is not operating to form an image. It is an additional advantage of the present embodiment that the liquid is equally agitated in each printhead during a maintenance mode by circulating the liquid through each printhead individually in any sequence during a maintenance mode.

In an embodiment, the time of circulation in each liquid handling system is set according to the consumption of liquid of each corresponding printhead between two maintenance actions. It is an additional advantage of the present embodiment that the liquid is agitated first in the printhead where consumption of liquid is the least.

BRIEF DESCRIPTION OF THE DRAWINGS

The present invention will become more fully understood from the detailed description given herein below and accompanying schematic drawings which are given by way of illustration only and are not limitative of the invention, and wherein:

FIG. 1 schematically illustrates a printer having three printheads and three liquid handling systems according to the present invention.

DETAILED DESCRIPTION

The present invention will now be described with reference to the accompanying drawings, wherein the same reference numerals have been used to identify the same or similar elements throughout the several views FIG. 1 schematically shows a printer having three printheads (2*a,* 2*b,* and 2*c*), being in a liquid connection with an intermediate liquid reservoir (1) which enables liquid to be drawn into the printheads by means of valves (4*a,* 4*b,* and 4*c*). Liquid can be drawn out of the printhead by means of valves (3*a,* 3*b,* and 3*c*) back into the liquid connection between the intermediate liquid reservoir (1) and the liquid supply container (5). The valves (3*a,* 3*b,* 3*c,* 4*a,* 4*b,* and 4*c*) are controlled by means of a controller (8) and can be controlled individually and can be set differently from each other. Furthermore the printer shown in FIG. 1 comprises a valve (6) and a pump (7) to regulate the flow from the liquid supply container (5) to the intermediate liquid reservoir (1).

In an embodiment the printer is in a printing mode, creating images by ejecting an ink onto a print medium, all printheads (2*a,* 2*b,* and 2*c*) are jetting an ink while ink is drawn from the intermediate liquid reservoir (1) by means of valves (4*a,* 4*b,* and 4*c*).

When one of the printheads (2*a,* 2*b,* and 2*c*), for example printhead (2*b*), is not ejecting ink for a certain period of time the ink may be recirculated from that particular printhead to the intermediate liquid reservoir (1) to prevent settling of ink in that particular printhead and ink circuit. Valve (3*b*) will be opened to enable ink to be drawn from printhead (2*b*) back to the intermediate liquid reservoir (1) and valve (4*b*) will also be opened to allow ink to be drawn back into printhead (2*b*). At the same time, valves (3*a*) and (3*c*) are closed to prevent ink to be drawn from printheads (2*a*) and (2*c*). Thus, ink is circulated through a single printhead while the other printheads are still in a printing mode. It goes without saying that it is possible to randomly select any combination of one or more printheads for circulation of ink. In another embodiment the printer is not in a printing mode, thus all printheads being in a standby mode or a maintenance mode, and all printheads (2*a,* 2*b,* and 2*c*) are not jetting ink.

As all printheads (2*a,* 2*b,* and 2*c*) are not jetting ink the ink may be circulated through the printheads to prevent settling of ink in those printheads. For sufficient agitation of ink, the ink is circulated through only one printhead at a time. So first ink will be circulated through a first printhead (2*a*) by opening valves (3*a*) and (4*a*) while valves (3*b*), (4*b*), (3*c*), and (4*c*) are closed to prevent circulation of ink through printheads (2*b*) and (2*c*).

When ink is sufficiently agitated in printhead (2*a*), valves (3*a*) and (4*a*) will be closed and valves (3*b*) and (4*b*) will be opened to enable circulation of ink through printhead (2*b*).

When ink is sufficiently agitated in printhead (2*b*), valves (3*b*) and (4*b*) will be closed and valves (3*c*) and (4*c*) will be opened to enable circulation of ink through printhead (2*b*). Again it goes without saying that it is possible to randomly select any combination of one or more printheads for circulation of ink.

This sequence may be repeated as often as needed until the printer goes back into a printing mode.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for circulation of a liquid in a printer, wherein the printer comprises an intermediate liquid reservoir, a controller for controlling the circulation of the liquid, and a first liquid handling system and at least one second liquid handling system, wherein each liquid handling system comprises:

a printhead, being in liquid connection with the intermediate liquid reservoir; and a means for circulating a liquid to the intermediate liquid reservoir, and a valve to regulate the circulation, wherein the method comprises the steps of opening the valve to regulate the circulation in the first liquid handling system;

closing the valve to regulate the circulation in the at least one second liquid handling system; activate the means for circulating the liquid to the intermediate liquid reservoir to start circulation of the liquid from the printhead in the first liquid handling system back to the intermediate liquid reservoir, while simultaneously drawing liquid from the intermediate liquid reservoir into the printhead in the first liquid handling system.

2. A method according to claim 1, wherein the circulation is regulated during a printing mode of the printer in which the printer is operating to form an image.

3. A method according to claim 2, wherein the circulation of each liquid handling system is dynamically adjusted according to the consumption of liquid of each corresponding printhead.

4. A method according to claim 3, wherein the controller adjusts the settings of any of the valves dependent on the image being printed.

5. A method according to claim 4, wherein the time of circulation in each liquid handling system is set according to the consumption of liquid of each corresponding printhead between two maintenance actions.

6. A method according to claim 1, wherein the circulation is regulated during a maintenance mode of the printer in which the printer is performing maintenance action and is not operating to form an image.

* * * * *